US007059012B2

(12) United States Patent
Song et al.

(10) Patent No.: US 7,059,012 B2
(45) Date of Patent: Jun. 13, 2006

(54) ROBOT VACUUM CLEANER WITH AIR AGITATION

(75) Inventors: Jeong-gon Song, Gwangju (KR); Jang-youn Ko, Gwangju (KR); Hwa-gyu Song, Gwangju (KR); Dong-lyoul Shin, Suwon (KR); Krasnoslobodtsev Valeri, Suwon (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 308 days.

(21) Appl. No.: 10/289,324

(22) Filed: Nov. 7, 2002

(65) Prior Publication Data

US 2003/0192144 A1 Oct. 16, 2003

(30) Foreign Application Priority Data

Apr. 16, 2002 (KR) ..... 2002-20546

(51) Int. Cl.
*A47L 5/14* (2006.01)

(52) U.S. Cl. ..... 15/340.3; 15/346; 15/347

(58) Field of Classification Search ..... 15/346, 15/347, 340.1, 340.3, 383, 345
See application file for complete search history.

(56) References Cited

U.S. PATENT DOCUMENTS

| | | | | |
|---|---|---|---|---|
| 4,107,816 | A * | 8/1978 | Matthews | 15/320 |
| 4,204,298 | A * | 5/1980 | Handa et al. | 15/346 |
| 4,393,536 | A | 7/1983 | Tapp | |
| 4,884,315 | A * | 12/1989 | Ehnert | 15/346 |
| 5,682,313 | A | 10/1997 | Edlund et al. | |
| 5,940,927 | A | 8/1999 | Haegermarck et al. | |

FOREIGN PATENT DOCUMENTS

| | | | |
|---|---|---|---|
| DE | 1628776 | A4 | 6/1971 |
| DE | 19520532 | A1 | 1/1996 |
| DE | 4430226 | A1 | 2/1996 |
| DE | 69701375 | T2 | 8/2000 |
| EP | 0430415 | A | 6/1991 |
| EP | 0963731 | A1 | 12/1999 |
| EP | 1003 088 | | 5/2000 |
| EP | 1097 666 | | 5/2001 |
| GB | 2138280 | A | 10/1984 |
| GB | 2 338 404 | | 12/1999 |
| JP | 03-162814 | | 7/1991 |
| JP | H05-09448 | | 2/1993 |
| JP | 11-089763 | | 4/1999 |
| JP | 2000-135178 | | 5/2000 |
| JP | 2002-085303 | | 3/2002 |
| WO | WO 00/25653 | A1 | 5/2000 |

* cited by examiner

*Primary Examiner*—Theresa T. Snider
(74) *Attorney, Agent, or Firm*—Plumsea Law Group, LLC

(57) ABSTRACT

A robot vacuum cleaner comprises a cleaner body having a wheel disposed at a lower portion and a suction port through which contaminants are drawn in from a cleaning surface; and an air circulating mechanism for filtering out contaminants from the contaminant-laden air drawn in through the suction port and then jetting the contaminant-free air to an air jet opening to help dislodge contaminants from the cleaning surface. The air jet opening is adjacent to the suction port; and the two elements are surrounded by a sealing member for sealing off a portion between the cleaning surface and the cleaner body to prevent dislodged contaminants from being dispersed outwardly.

4 Claims, 2 Drawing Sheets

ROBOT VACUUM CLEANER WITH AIR AGITATION

BACKGROUND OF THE INVENTION

1. Field of the Invention

The present invention relates to a robot vacuum cleaner, and more particularly, to a robot vacuum cleaner providing agitation to the cleaning surface by action of both air jets directed at the surface and agitation brushes.

2. Description of the Related Art

Generally, a robot vacuum cleaner draws in contaminants such as dust from a surface to be cleaned while automatically traveling an area without being manually guided by a user. Such a robot vacuum cleaner detects an obstacle such as furniture, appliances, or a wall in the cleaning area by a distance sensor relative to its position. The robot vacuum cleaner selectively drives a right wheel motor and/or a left wheel motor to automatically change its traveling direction and thereby performs a cleaning operation in the cleaning area.

As shown in FIG. 1, a conventional robot vacuum cleaner comprises a cleaner body 10, a driving wheel 11 and a driven wheel 12 which are disposed at a lower portion of the cleaner body 10. An upper portion of the cleaner body 10 is provided with an antenna 13 for receiving and transmitting signals to and from a remote controller and a distance sensor 14. The movement of a robot vacuum cleaner will necessarily require it to move in many different directions, for consistency of explanation, this description refers to the front and rear of the robot vacuum cleaner with reference to its straight-away forward moving orientation. The interior of the cleaner body 10 is provided with a driving motor (not shown) for generating a suction force, a contaminant collecting receptacle and a filter. The suction force is transmitted from the driving motor to a suction port 15, which is disposed at the lower portion of the cleaner body 10 to draw in contaminants and dust from the cleaning surface through the suction port 15 and eventually into the receptacle.

Conventional robot vacuum cleaners sometimes do not remove contaminants completely, especially contaminants embedded in a carpet or stuck to the cleaning surface. This can be particularly irritating or even become a hazard if fine contaminants such as dust, dust mites or other allergens are left behind. Conventional robot vacuum cleaners determine the cleaning operation to be finished once an area is covered and will stop the cleaning operation even if fine contaminants are left behind. That is because the suction force at the suction port 15 is generally not strong enough to completely remove contaminants that are embedded in or stuck to the cleaning surface.

SUMMARY OF THE INVENTION

The present invention has been developed to address the above-mentioned drawbacks. Accordingly, it is an object of the present invention to provide a robot cleaner capable of more effectively removing contaminants from a cleaning surface by providing two forms of agitation to the surface including a brushing motion to move the contaminants off of the cleaning surface and an air jet action to help dislodge contaminants which are caught on the cleaning surface. The robot vacuum cleaner of the present invention also provides for a means to prevent the brushed or air-agitated contaminants from being scattered beyond the area of the suction port.

In order to achieve the above objects, a robot vacuum cleaner according to the present invention comprises a cleaner body having a wheel disposed at a lower portion and a suction port through which contaminant is drawn in from a cleaning surface; and at least one means of agitation including an air circulating mechanism for filtering out contaminants from the contaminant-laden air drawn in through the suction port and recirculating the filtered air to an air jet opening to help dislodge contaminants from the cleaning surface. The air jet opening is provided proximate to the suction port; and is largely surrounded by a sealing member for sealing off a portion of the cleaning surface near the cleaner body to prevent the contaminants scattered by the air jet from being dispersed outwardly.

The air circulating mechanism comprises a circulating pump disposed inside the cleaner body; an air suction pipe connecting the circulating pump to the suction port; a filter coupled to the air suction pipe; and an airjet pipe connecting the circulating pump to the air jet opening proximate the suction port. The air jet opening is disposed foreward of the suction port and provides cleaned air to the cleaning surface to help dislodge contaminants from the carpet or other material so that the contaminants can be collected through the suction port.

A sealing member is disposed along a lower surface of the cleaner body and in contact with the cleaning surface to thereby surround the suction port and the air jet opening to prevent dislodged contaminants from being scattered outward.

BRIEF DESCRIPTION OF THE DRAWINGS

The above object and characteristic of the present invention will be more apparent by describing a preferred embodiment of the present invention in greater detail with reference to the accompanying drawings, in which.

DETAILED DESCRIPTION OF THE PREFERRED EMBODIMENT

Figure 1:
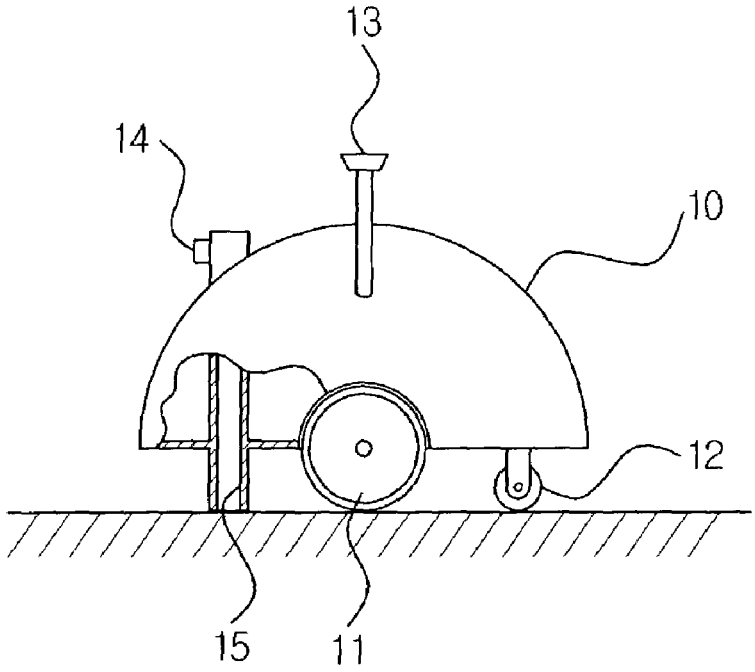
FIG.1 (PRIOR ART)
FIG. 1 is a schematic side section view showing a conventional robot vacuum cleaner.
Figure 2:
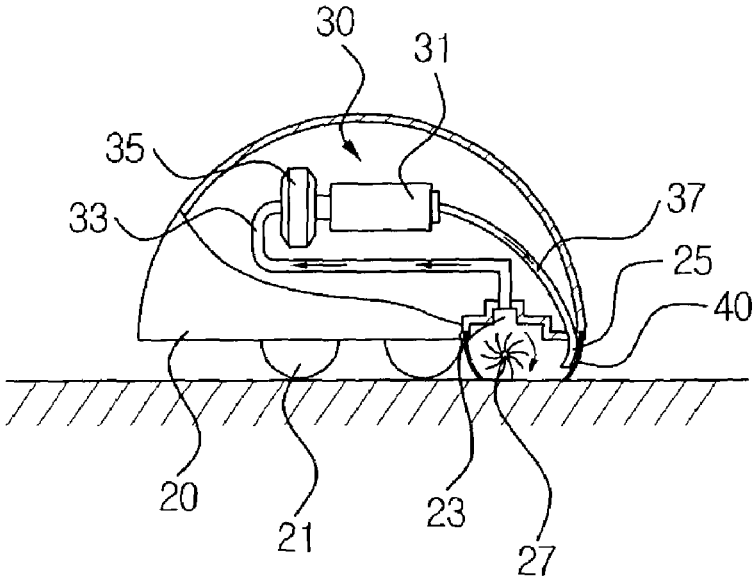
FIG. 2 is a schematic side section view showing a robot vacuum cleaner according to a preferred embodiment of the present invention.
Figure 3:
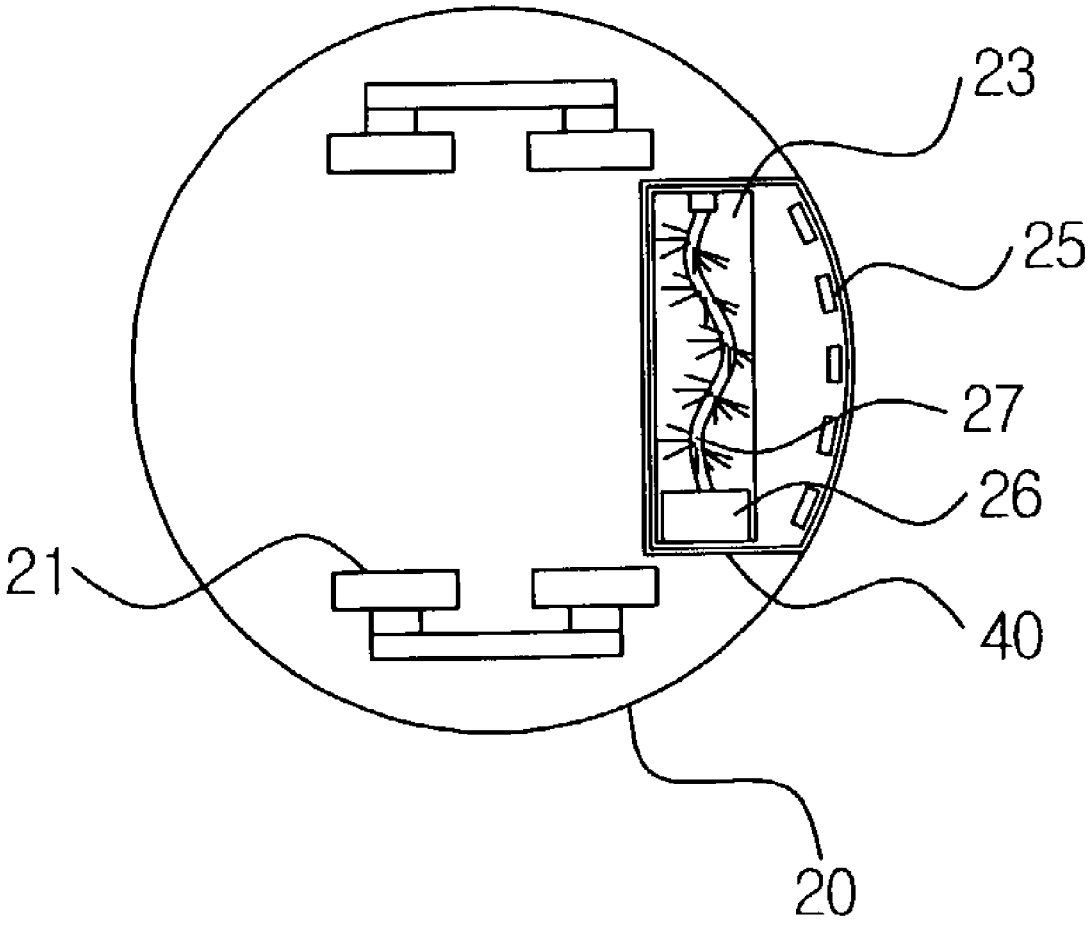
FIG. 3 is a bottom view showing the robot vacuum cleaner of FIG. 2.

Referring to FIGS. 2 and 3, a robot vacuum cleaner according to the present invention comprises a cleaner body 20, in addition to the known components for conventional robot vacuum cleaners includes an air circulating mechanism 30 disposed inside the cleaner body 20, and a sealing member 40.

The cleaner body 20 automatically travels a cleaning area to perform the cleaning operation. To accomplish this task, the cleaner body 20 has a plurality of wheels 21 disposed on a lower portion thereof as well as a suction port 23 for drawing in contaminants and dust from a cleaning surface together with air therethrough. Cleaner body 20 is also equipped with an air jet opening 25 or a group of such openings disposed adjacent to the suction port 23 on the underside of the body. Air jet opening or openings 25 are designed to enhance the cleaning operation by providing air agitation to the cleaning surface to help dislodge contaminants so they can be easily be drawn in by the suction port.

The suction port 23 is also provided with a rotation brush 27, which is rotatably driven by a motor 26. The suction brush 27 preferably has a structure in which a plurality of brushes are connected to a flexible wire shaft. When the wire shaft is rotated by the motor 26, the suction brush 27 brushes the contaminants off of the cleaning surface to provide additional agitation to help dislodge contaminants. The brushing action in combination with the airjet action provide a more thorough cleaning than with suction force alone.

The air jet opening 25 is disposed adjacent to the suction port 23, and preferably ahead of the suction port 23 in a foreward direction of the cleaner body 20. It is preferred that the air jet opening 25 is provided in plural numbers and in nozzle form. The cleaned air is jetted toward the cleaning surface through the air jet opening 25 to help dislodge contaminants from the cleaning surface and disperse the contaminants into the air near the suction port. The action of the air jet provides needed agitation to the cleaning surface. In combination with the suction brush the air jet opening provides two forms of agitation over a suction port alone. The added agitation aides in dislodging embedded particles and enhances removal of contaminants stuck to the cleaning surface.

The self-contained air circulating mechanism 30 filters out contaminants from the air which is drawn in through the suction port 23, and then jets the cleaned air to the air jet opening 25. The air circulating mechanism 30 comprises a circulating pump 31 disposed inside the cleaner body 30, an air suction pipe 33 connecting the circulating pump 31 to the suction port 23, a filter 35 disposed at the air suction pipe 33 for filtering out the contaminant from the drawn-in air, and an air jet pipe 37 connecting the circulating pump 31 to the air jet opening 25. Accordingly the air drawn in through the suction port 23 is circulated through the air suction pipe 33, the filter 35, the circulating pump 31, and the air jet pipe 37 and then is jetted to the air jet opening 25.

Due to the agitation of the air jet opening and the suction brush, dislodged contaminants near the suction port are necessarily scattered and blown around before they are entrained into the suction port. In order to contain the contaminants a sealing member 40 surrounds the suction port area to seal off the space between the cleaning surface and the body 30 to prevent contaminants scattered by the air from the air jet opening 25 from being dispersed outwardly. The sealing member 40 protrudes from a lower surface of the cleaner body 30 to contact the cleaning surface, enclosing a circumference of the suction port 23 and the air jet opening 25. Preferably, the sealing member 40 is made of resiliently deformable material such as rubber or other material having elastomeric properties to conform to the sealed area. When the cleaner body 30 travels, the sealing member 40 remains in contact with the cleaning surface to hold the contaminants scattered from the cleaning surface within a predetermined space, thereby enabling all of the contaminants to be drawn in through the suction port 23. The sealing member 40 is preferably shaped like a skirt.

In the robot cleaner according to the present invention as described above, the structure of re-jetting the drawn-in air allows an effective removal of the contaminant and dust off from the cleaning surface. Also, the sealing member 40 prevents the scattered contaminant from being dispersed outwardly and re-contaminating the cleaning surface, resulting in an effective cleaning operation.

Although the preferred embodiments of the present invention have been described, it will be understood by those skilled in the art that the present invention should not be limited to the described preferred embodiments, but various changes and modifications can be made within the spirit and scope of the present invention as defined by the appended claims.

What is claimed is:

1. A robot vacuum cleaner comprising:

a cleaner body having a suction port through which contaminants can be drawn in from a cleaning surface;

an air agitation device mounted in said cleaner body to provide an air jet to the cleaning surface to dislodge contaminants;

an agitation brush operatively coupled to said suction port to provide additional agitation to the cleaning surface; and a skirt sealing member of a continuous resiliently deformable material protruding from a lower surface of said cleaner body to contact the cleaning surface and surrounding both said suction port and said air jet exit opening for containing dislodged contaminants.

2. The robot vacuum cleaner of claim 1, wherein said air agitation device comprises:

an air inlet equipped with a filter for filtering contaminant-laden air drawn in through said suction port;

an air jet exit opening proximate said suction port; and a circulating path to jet filtered air through said air jet exit opening.

3. The robot vacuum cleaner of claim 2, further comprising a circulating pump in said circulating path operatively coupling said air inlet and said air jet exit opening.

4. A robot vacuum cleaner comprising:

a cleaner body having a suction port through which contaminants can be drawn in from a cleaning surface;

an air agitation device mounted in said cleaner body to provide an air jet to the cleaning surface to dislodge contaminants, said air agitation device comprising an air inlet equipped with a filter for filtering contaminant-laden air drawn in through said suction port, an air jet exit opening proximate said suction port, and a circulating path to jet filtered air through said air jet exit opening;

an agitation brush operatively coupled to said suction port to provide additional agitation to the cleaning surface;

a circulating pump in said circulating path operatively coupling said air inlet and said air jet exit opening; and a skirt sealing member of a continuous resiliently deformable material protruding from a lower surface of said cleaner body to contact the cleaning surface and surrounding both said suction port and said air jet exit opening for containing dislodged contaminants.

* * * * *